US007621289B2

(12) United States Patent
Ju

(10) Patent No.: US 7,621,289 B2
(45) Date of Patent: Nov. 24, 2009

(54) CONNECTOR OF INSTANT SET-UP FOLDABLE TENT FRAME

(75) Inventor: Dong S. Ju, Seoul (KR)

(73) Assignee: Baejin Corporation, Seoul (KR)

( * ) Notice: Subject to any disclaimer, the term of this patent is extended or adjusted under 35 U.S.C. 154(b) by 217 days.

(21) Appl. No.: 11/059,288

(22) Filed: Feb. 15, 2005

(65) Prior Publication Data

US 2006/0180190 A1 Aug. 17, 2006

(51) Int. Cl.
*E04H 15/32* (2006.01)

(52) U.S. Cl. ..... 135/120.3

(58) Field of Classification Search ..... 135/120.3, 135/114, 120.1, 31, 909, 130, 143, 144, 146; 403/265, 267, 93, 92
See application file for complete search history.

(56) References Cited

U.S. PATENT DOCUMENTS

| | | | | |
|---|---|---|---|---|
| 4,750,509 | A | 6/1988 | Kim | |
| 5,002,083 | A * | 3/1991 | Kim | 135/98 |
| 5,195,551 | A * | 3/1993 | Ju | 135/126 |
| 5,666,986 | A * | 9/1997 | Fox | 135/135 |
| 5,884,646 | A * | 3/1999 | Ju | 135/135 |
| 6,679,643 | B1 * | 1/2004 | Ham | 403/102 |
| 6,772,780 | B2 * | 8/2004 | Price | 135/131 |
| 7,040,585 | B2 * | 5/2006 | Cheng et al. | 248/200 |
| 2006/0037636 | A1 * | 2/2006 | Lin | 135/98 |
| 2006/0162756 | A1 * | 7/2006 | Gao | 135/98 |
| 2007/0023074 | A1 * | 2/2007 | Choi | 135/120.3 |

FOREIGN PATENT DOCUMENTS

| | | |
|---|---|---|
| KR | 0039905 | 3/1989 |
| KR | 0109306 | 11/1992 |
| KR | 0129575 | 8/1998 |
| KR | 0289476 | 9/2002 |

* cited by examiner

*Primary Examiner*—David Dunn
*Assistant Examiner*—Noah Chandler Hawk
(74) *Attorney, Agent, or Firm*—J. Bennett Mullinax, LLC

(57) ABSTRACT

A connector of instant set-up foldable tent frame articular includes an upper joint and a lower joint. The upper joint has (a) brackets to be connected with a lower joint, engaging portions formed at the lower end portion of said brackets for engagement with a locking lever, (c) a sloped surface formed between said brackets, and (d) a collar. The lower joint has (a) a connecting portion to be connected to said upper joint by insertion between said brackets, and (b) a sloped surface formed at the upper surface of said connecting portion. The articular connector is characterized in that the connecting portion of the lower joint is connected to the upper joint by insertion between said brackets of the upper joint by means of pin holes and a pin enabling said two joints to perform articular operations. A method of using the connector of instant set-up foldable tent frame is also disclosed.

4 Claims, 4 Drawing Sheets

CONNECTOR OF INSTANT SET-UP FOLDABLE TENT FRAME

BACKGROUND OF THE INVENTION

Field of the Invention and Related Prior Art

The present invention relates to a connector of instant set-up foldable tent frames.

As illustrated by FIG. 1, a foldable tent frame generally comprises a few unit frame sections of certain lengths that are connected by an articular connecting means to be folded or unfolded for portability or to be assembled to form one integrated piece for pitching.

A number of connecting means of various structures have been made public for tent frame sections. Several prior arts in respect of a series of connecting means for tent frame sections have been registered as Utility Model by the applicant of the present invention as cited below.

In the "Connector for a Tent Frame", Korean Utility Model Reg. No. 0109306 (Registration Date 5 Sep. 1997), the upper and the lower joints of two tent frame sections are joined together via a hinge pin, and a bolt is installed in a lower joint against a spring in such a way that the bolt can be manipulated to move horizontally via a knob. When the upper joint is unfolded in a linear fashion, the bolt is pushed into a longitudinal hole on the upper joint, securely locking the two frame sections together, and the upper and lower joints can be separated and folded by pulling the knob backward.

In this construction, the bolt is constantly kept in its engaged position by a spring force, requiring a manual retreat of the bolt for unfolding of the two joints causing inconvenience to the user and frequent breakdowns of the joints. As the bolt is not visible from outside, careless folding attempts are apt to damage the butts of the joints.

In the "Folding Device of a Tent-Framework," U.S. Pat. No. 4,750,509; "Foldable frame connecting means for general use", Korean Utility Model Reg. No. 0039905 (Registration Date 15 Mar. 1989), two connecting tubes respectively fitted to each tent frame section are constructed to join together via a connecting pin, and an extension part is formed on one connecting tube while a tube socket is installed against a coil spring on the other connecting tube. The connecting tube is then unfolded outward in a linear fashion by pulling the tube socket back and engaged with an extended piece of the opposing tube to lock. The two connecting tubes can be folded by pulling the tube socket back.

In this construction, the complicated processes of pushing the tube socket against the spring and engaging the tube socket with the extension piece cause inconvenience and pose a danger of a finger being pinched by the spring force working against the tube socket.

In "Connector for Dome Type Tent frames", Korean Utility Model Reg. No. 0129575 (Registration Date 20 Aug. 1998), one of the two joints connected with a pin is provided with an extension piece at its front end while the other is provided with a spring operated manipulation tube that moves back and forth, wherein two connecting tubes are unfolded by retreating the manipulation tube and locked together in a linear fashion by releasing the manipulation tube to let the spring force work.

While the construction has an advantage of neat appearance and solid structure, it requires an inconvenience of moving the manipulation tube in an axial direction every time the connecting tube is to be unfolded and poses a danger of a finger being pinched by the manipulation tube.

In the "Instant Connector in a Foldable Tent Frame", Korean Utility Model Reg. No. 0289476 (Registration Date 3 Sep. 2002), the upper joint connected by a pin has brackets provided with a rod in a shape of gently sloping wedge and the lower joint has a push lever provided with a slightly curled up flat hook and positioned against a spring. When the two joints are unfolded, the gently sloping rod provided in the brackets engages with the inclined flat hook in the push lever to lock. When the push lever is pressed, the locking is released to allow folding of these joints.

The structure of this connecting means renders best convenience in terms of unfolding and folding processes of the joints as compared to those of said prior arts. But, the portion of the inclined flat hook being exposed to heavier impacts is susceptible to wear and tear, affecting the effectiveness of its locking function.

SUMMARY OF THE INVENTION

The objective of the present invention is to provide an articular tent frame connector for an instant set-up foldable tent whose structure is simple and firm and is convenient to use.

Another objective of the present invention is to provide an articular tent frame connector which, when the tent frames are unfolded and stretched into a linear form by the connector, maintains the tent frames firmly in position, preventing the tent frames from being folded or deformed against the pressure of a load of the tent or the wind thus enhancing the safety of the connector.

Another objective of the present invention is to provide an articular tent frame connector which is easy to use so that if the user presses the locking lever, the connector folds the tent frames in a simple manner, and if the user unfolds the folded connector into a linear form, the connector is locked automatically, maintaining the tent frames firmly in a linear form.

The present invention is related specifically with the Korean Utility Model Reg. No. 0289476 "instant set-up connector of a foldable tent frame" (Registration Date: 3 Sep. 2002) which is mentioned above as a prior art relating to a construction of the connecting means of foldable tent frames, and the present invention represents an invention of a new connecting means for tent frame sections, in which the advantages of the connecting means of the prior art are retained while shortcomings are replaced with new systems introducing a new, creative tent frame connector, making it easy and safe to use.

In an articular connecting means of tent frame sections of a instant set-up foldable tent in the present invention, there is an upper joint to which an upper tent frame section is connected. The upper joint has a pair of brackets formed on both sides facing each other at a certain distance and having a pin hole on each side designed to connect a lower joint connected with another tent frame section. At the lower end of each bracket is formed an engaging portion (2*c*) for engagement with the acute angled upper end portion (4*a*) of a locking lever (4). The interior of the upper joint between said brackets is formed with a sloped surface. The lower joint of the connector to which the lower tent frame section is connected has a link portion (3*a*) that connects the lower joint to the upper joint by inserting it between the brackets of the upper joint by means of an axial pin. The upper surface of the link portion is of a sloped form for close contact with the sloped surface of the upper joint. The link portion of the lower joint is inserted between the brackets of the upper joint connecting the two joints by means of the pin hole and the axial pin enabling an articular operation of the upper and lower joints. In the indent portion formed in the lower portion of the lower joint, a locking lever is installed through a pin with a spring so as to be kept supported and pressed against the lower joint in such a way that the locking lever (4) is engaged with the engaging portion (2*c*) of the upper joint when the two joints are unfolded and stretched. The locking lever maintains its close contact with the lower joint by the elasticity of a spring preventing the upper joint from being folded, as the upper portion of the locking lever is engaged with the engaging portion of the upper joint firmly.

The connector of the present invention is an articular connector having two joints that are connected with each joining portion of the tent frame sections.

The features of the instant set-up foldable tent of the present invention is such that the tent can be pitched through a simple procedure. The tent can be pitched by an instant set-up process because of the structure of the articular connector of the present invention and because of the features of the operation that is made possible by such a structure.

If the upper joint and the lower joint of the connecting means are unfolded into a linear form to pitch a tent, the interior sloped surface of the upper joint and the sloped upper surface of the lower joint come into close and firm contact and hold the two joints firmly, preventing further rotating movement of the upper joint. Meanwhile, the engaging portion formed in the brackets of the upper joint engages with the acute-angled upper end portion of the locking lever, holding the upper joint and the lower joint firmly in a linear fashion.

As the locking lever is kept pressed against the lower joint by the force of the elasticity of the spring and because the engaging portions at the brackets of the upper joint engage firmly with the acute-angled upper end portion of the locking lever at the position when the upper joint and the lower joint are unfolded and stretched in a linear fashion, the upper joint cannot be unfolded as it is unable to make a rotating movement, the engaging portions of the brackets being blocked by the acute-angled upper end portion of the locking lever. Therefore, unless the locking lever is released manually, the connector maintains the upper and the lower joints firmly in a linear fashion.

Accordingly, once the tent is set up, the tent frames firmly sustain the pitched tent in shape against the pressure of the wind, the joints of the connector never bending.

If the user wants to dismantle the tent, the user can just press the pushing plate of the locking lever and at the same time fold the upper and lower joints of the connector.

If the push plate of the locking lever is pressed toward the lower joint, the top end portion of the locking lever is released from the upper joint, making it possible for the upper joint to rotate toward the folding direction with a pin as a supporting axis. At this time, the engaging portions formed in the brackets are not blocked by the top end portion of the locking lever, allowing the upper joint to rotate freely, thus enabling the upper joint to fold smoothly toward the lower joint.

If the connectors are folded, the tent frames are folded into smaller lengths, making it possible to fold the tent and put it neatly into a tent bag.

By the present invention, the structure of the articular connector of the instant set-up foldable tent frames is made simple and firm, and it is easy to pitch or take down the tent.

The connector of the tent frames of the present invention sustains the tent firmly when unfolded in a linear fashion and maintains that state firmly and safely against the pressure of the wind, preventing the tent frame connectors from being folded or distorted. It is also easy to operate the connector, requiring no special skill. Anyone even without special knowledge can fold the connectors by pressing the push plate of the locking lever. If the connector is unfolded in a linear fashion, the joints are automatically locked, making it possible for the user to use the connectors more safely and conveniently compared with other conventional connectors of foldable tent frames.

The connector of instant set-up foldable tent frame of the present invention has other features and advantages which will be apparent from or are set forth in more detail in the accompanying drawings, which are incorporated in and form a part of this specification, and the following Detailed Description of the Invention, which together serve to explain the principles of the present invention.

DESCRIPTION OF SYMBOLS IN THE DRAWINGS

1: connector 1*a*, 1*b*: frame inserting portion
2: upper joint 2*b*: bracket 2*c*: engaging portion
2*d*: collar 2*h*: pin hole 2*s*: sloped surface (in the upper joint)
3: lower joint 3*a*: link portion 3*b*: indent portion
3*s*: sloped surface (of the lower joint) 3*x*: pin
4. locking lever 4*a*: upper end portion 4*b*: push lever
4*s*: spring 4*x*: pin

DETAILED DESCRIPTION OF THE INVENTION

Reference will now be made in detail to the preferred embodiments of the invention, examples of which are illustrated in the accompanying drawings. While the invention will be described in conjunction with the preferred embodiments, it will be understood that they are not intended to limit the invention to those embodiments. On the contrary, the invention is intended to cover alternatives, modifications and equivalents, which may be included within the spirit and scope of the invention as defined by the appended claims.

Figure 1:
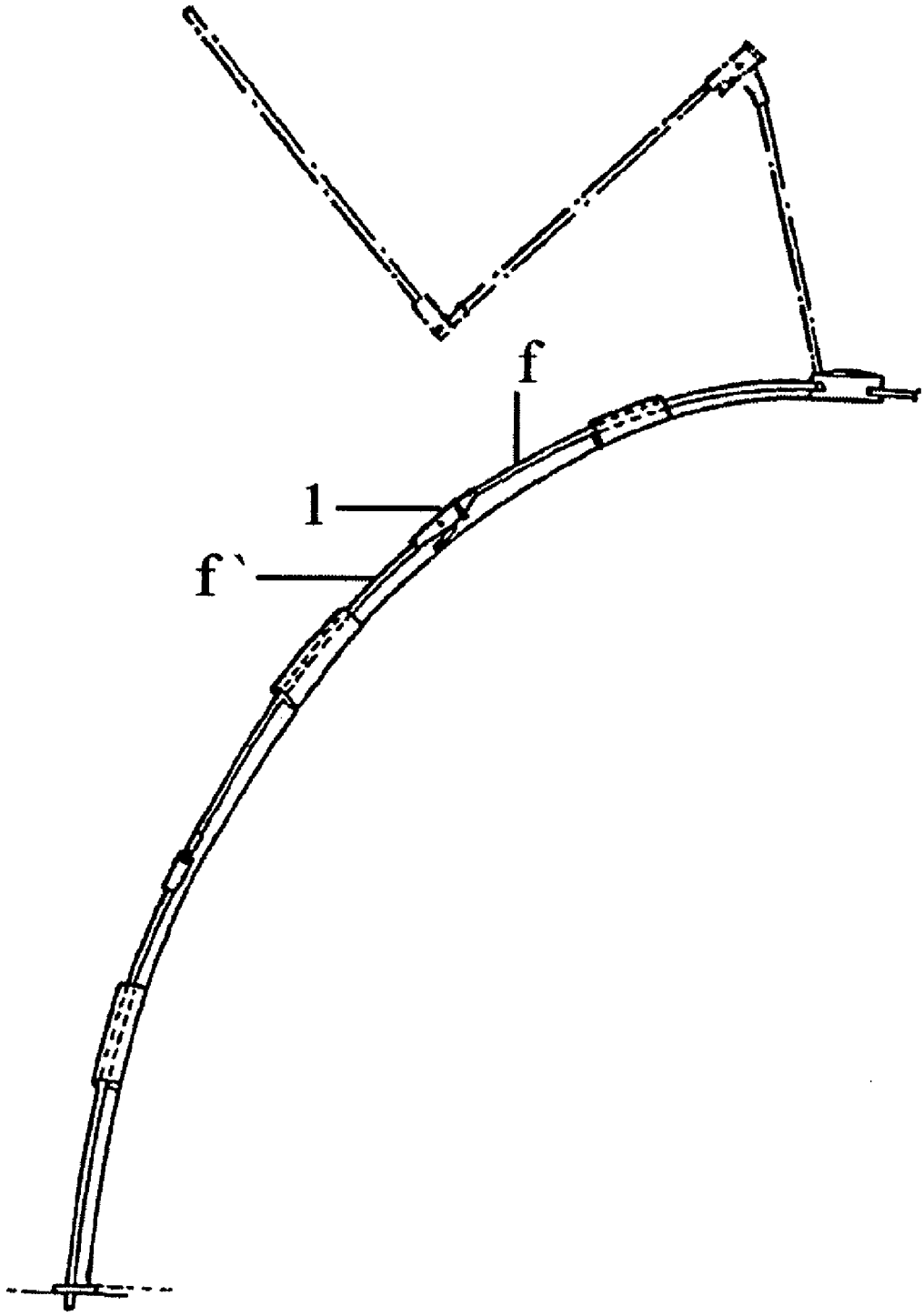
FIG. 1 illustrates the folding and unfolding of the tent frame sections of the present invention.
Figure 2:
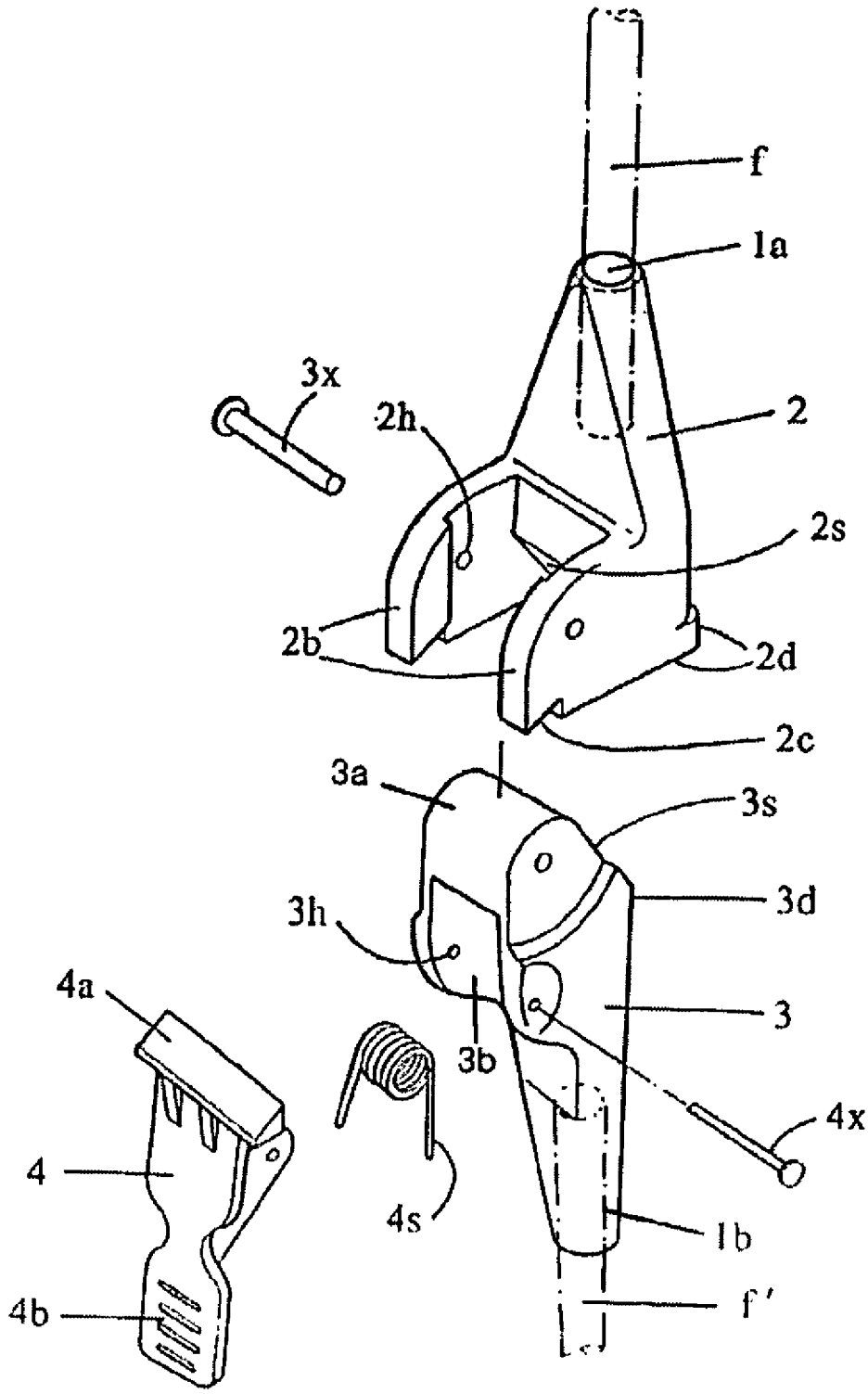
FIG. 2 is a dismantled perspective view of the frame connector of the present invention.

As shown in FIG. 1 and FIG. 2, in an articular connector of the connecting means of the frame sections in an instant set-up foldable tent, the upper joint (2) of the connector (1), which is connected to the upper tent frame section (f) by insertion into the inserting portion (1*a*), has two brackets (2*b*) right and left facing each other at a certain distance provided with pin holes (2*h*) to connect the lower joint (3) of the connector (1). At the lower end of each bracket (2*b*) is an engaging portion (2*c*) with which the acute-angled upper end portion (4*a*) of the locking lever (4) engages, and the interior surface between said brackets of the upper joint (2) consists of a sloped surface (2*s*). There is a collar (2*d*) formed at a lower end portion of said sloped surface (2*s*) so as to protect the upper portion of the lower joint (3).

The lower joint (3) of the connector (1), which is connected with the lower tent frame section (f) by insertion into the inserting portion (1*b*), has a link portion (3*a*) so as to be linked with the upper joint (2) by insertion into the brackets (2*b*) of the upper joint (2) through axial pin (3*x*). The upper surface of the link portion (3*a*) consists of a sloped surface (3*s*) designed for close contact with the sloped surface (2*s*) of the upper joint (2). The lower portion (3*d*) of the sloped surface (3*s*) is protected by the collar (2*d*) of the upper joint (2) when the upper and the lower joints are unfolded and stretched in a linear fashion. When the link portion (3*a*) of the lower joint (3) is inserted into the brackets (2*b*) of the upper joint (2), the upper joint (2) and the lower joint (3) are connected through pin holes (2*h*) and the pin (3*x*) for articular operations.

At the indent portion (3*b*) formed at the lower end portion of the lower joint (3), there is a locking lever (4) for engagement with the engaging portion (2*c*) formed at the brackets (2*b*) of the upper joint (2). The locking lever (4) is provided in such a way that it is kept supported and pressed against the lower joint (3) by a spring (4*s*) through a pin (4*x*). The acute-angled upper end portion (4*a*) of the locking lever (4) engages with the engaging portion (2*c*) of the brackets (2*b*) of the upper joint (2) for locking. If the push lever (4*b*) of the locking lever (4) is pressed, the locked state is released for the joints to be folded or to be unfolded thereafter.

The operations of the connector of the instant set-up foldable tent frames in the present invention are carried out as follows.

Figure 3:
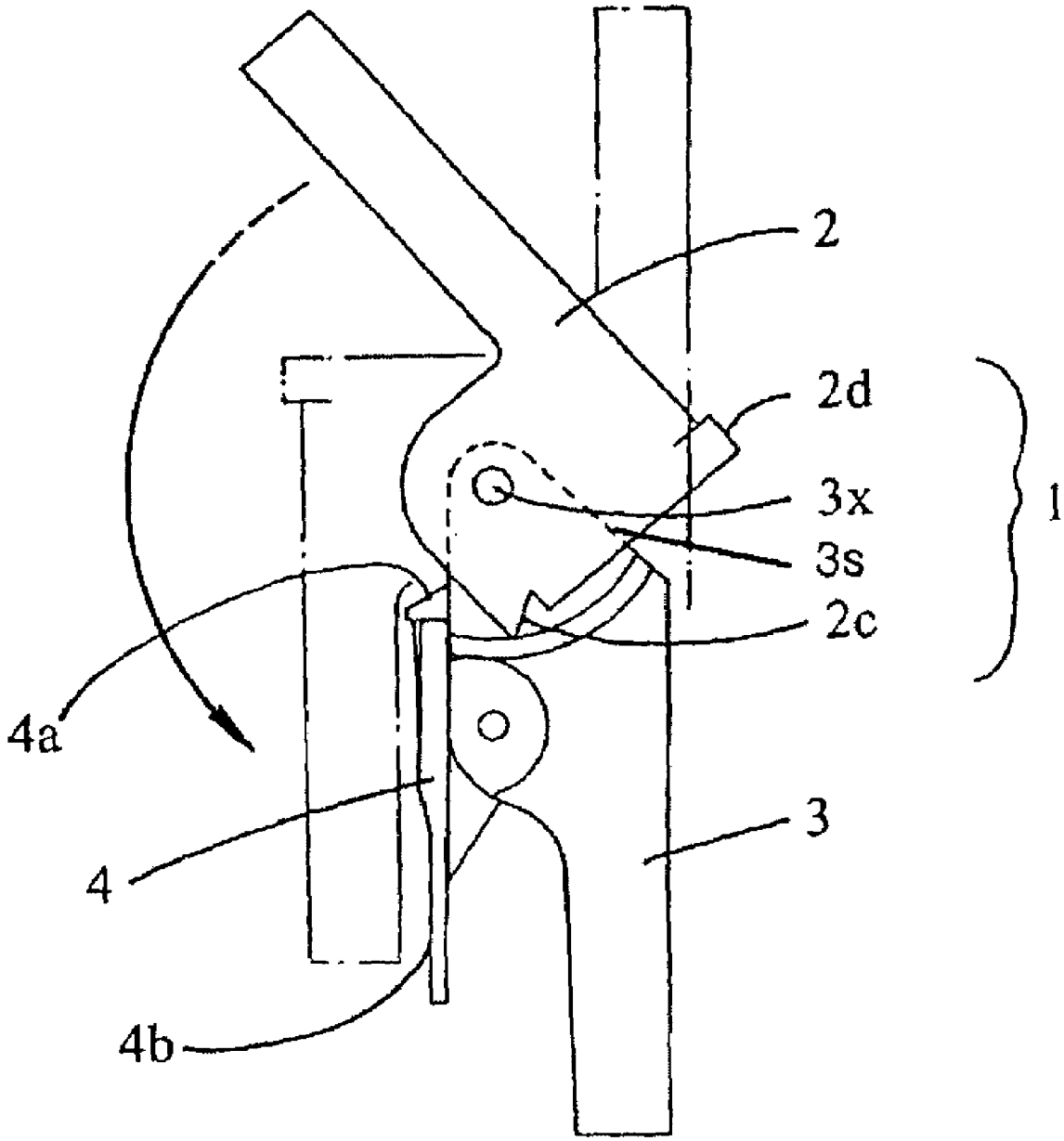
FIG. 3 illustrates how the lower and upper joints operate when folding and unfolding.
Figure 4:
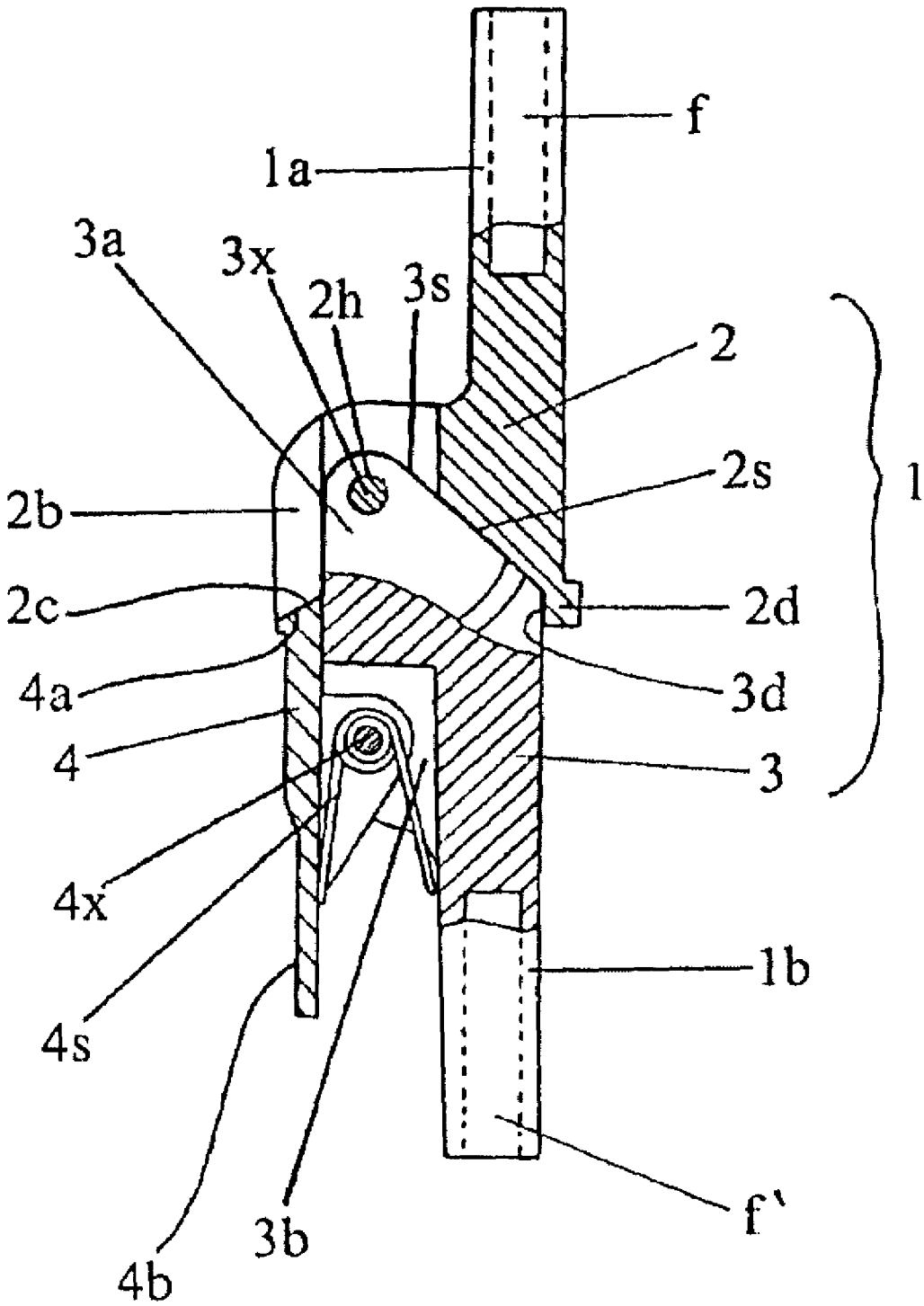
FIG. 4 is a sectional view of the joints unfolded in a linear fashion.

In the state of the tent being folded, as illustrated by a broken line in FIG. 3, the upper joint (2) of the tent frame connector (1) is folded toward the lower joint (3) with a pin (3*x*) as its supporting axis.

As illustrated by a full line in FIG. 3, if the upper joint (2) of the connector (1) is stretched into a linear form with the lower joint (3) in order to unfold and pitch the tent, the sloped surface (2*s*) of the upper joint (2) and the sloped surface (3*s*) of the lower joint (3) come into close contact, fixing the two joints firmly into a linear form, preventing further rotary movement of the joints.

In the unfolding process of the joints, the upper joint (2) with engaging portions (2*c*) formed at the lower end of the brackets (2*b*) rotates in a circular orbit with a pin (3*x*) as its axis, pushing the acute-angled upper end portion (4*a*) of the locking lever (4) toward the exterior of the lower joint (3). Then, when the upper joint (2) and the lower joint (3) are stretched into a precise linear form, said acute-angled upper end portion (4*a*) of the locking lever (4) engages with the engaging portions (2*c*) formed at the brackets (2*b*), making the upper joint (2) and the lower joint (3) firmly locked in a linear form. In addition, because the lower end portion of the sloped surface (2*s*) of the lower joint (3) is surrounded by the collar (2*d*) of the upper joint (2), the linear engagement of the upper and lower joints is further reinforced.

Because the locking lever (4) is always pressed against the lower joint (3) by the elasticity of the spring (4*s*), because the engaging portions (2*c*) formed at the brackets (2*b*) of the upper joint (2) rotate in a circular orbit as the upper joint (2) rotates with the pin (3*x*) as its axis and engage with the acute-angled upper end portion (4*a*) of the locking lever (4) firmly, it is impossible, after said engagement, to fold the upper joint (2) as the engaging portions (2*c*) of the brackets (2*b*) are blocked by the acute-angled upper end portion (4*a*) of the locking lever (4), making it impossible to make a rotary movement of the upper joint (2).

Therefore, the connector sustains the tent structures firmly, without bending against the load of the tent or against the pressure of the wind when the tent is pitched.

If the user wants to dismantle the tent, the user may push the push lever (4*b*) of the locking lever (4) of the connector (1) toward the lower joint (3) and fold the upper joint (2) and the lower joint (3) of the connector (1). If the push lever (4*b*) of the locking lever (4) is pushed toward the lower joint (3), the acute-angled upper end portion (4*a*) of the locking lever (4) is released from engagement with the engaging portions (2*c*) of the brackets, allowing the upper joint (2) to make a rotary movement with the pin (3*x*) as its axis, enabling the upper joint (2) to fold toward the lower joint (3) smoothly.

If the connector (1) is folded, the tent frames are folded into smaller lengths, making it possible to fold the tent neatly and put it in a bag.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the Claims appended hereto and their equivalents.

What is claimed is:

1. An articular connector of instant set-up foldable tent frames, comprising:

an upper joint having (a) brackets to be connected with a lower joint;

(b) engaging portions formed at the lower end portion of said brackets for engagement with a locking lever;

(c) a sloped surface formed between said brackets;

(d) a collar formed at a lower end of said sloped surface, wherein said collar has an inner surface, an outer surface, and a bottom surface;

a lower joint having (a) an inserting portion having a longitudinal axis and configured for receipt of a lower tent frame section;

(b) a connecting portion to be connected to said upper joint by insertion between said brackets;

(c) a sloped surface formed at the upper surface of said connecting portion and extending from a curved surface formed at said upper surface of said connecting portion, wherein said sloped surface has a bottom edge that is contiguous with an outer side surface of said lower joint extending linearly from the bottom edge of the inserting portion to the sloped surface across the entire length of said bottom edge, wherein the entire said sloped surface extending from said bottom edge to said curved surface is a single planar surface that has a surface normal that is not parallel with said longitudinal axis of said inserting portion and contacts a planar portion of said sloped surface of said upper joint when said upper joint and said lower joint are arranged in an unfolded position with respect to one another, wherein said curved surface does not contact said sloped surface of said upper joint when said upper joint and said lower joint are arranged in the unfolded position with respect to one another, wherein the portion of said side surface contiguous with said bottom edge of said sloped surface of said lower joint has a surface normal that is not parallel with said longitudinal axis of said inserting portion;

wherein the connecting portion of the lower joint is connected to the upper joint by insertion between said brackets of the upper joint by means of pin holes and a pin enabling said two joints to perform articular operations; and a locking lever in pivoting engagement with the lower joint, wherein said locking lever is capable of pivoting about an axis, and wherein the axis about which said locking lever is capable of being pivoted is parallel to the axis of said pin, and wherein said locking lever is capable of engaging said engaging portions of said brackets in order to lock the position of said upper joint with respect to said lower joint;

wherein when said upper joint and said lower joint are arranged in an unfolded position with respect to one another said inner surface of said collar contacts said outer side surface of said lower joint, and wherein said outer surface of said collar and said bottom surface of said collar do not contact said lower joint when said upper joint and said lower joint are arranged in the unfolded position with respect to one another.

2. An articular connector of instant set-up foldable tent frames according to claim 1, wherein said locking lever is provided at an indent portion at a lower end portion of the lower joint for engagement with said engaging portions of the brackets of the upper joint, said locking lever being kept supported and pressed against the lower joint by means of a spring and a pin.

3. An articular connector of instant set-up foldable tent frames according to claim 1, wherein if the upper joint and the lower joint of the connector are unfolded and stretched into a linear form, the sloped surface of the upper joint and the sloped surface of the lower joint come in close contact and wherein said locking lever has an acute-angled upper end portion wherein the acute-angled upper end portion of the locking lever engages with the engaging portion of the upper joint to lock said two joints firmly, and wherein said inner surface of said collar does not contact said sloped surface of said lower joint when said sloped surface of said upper joint and said sloped surface of said lower joint are in close contact.

4. An articular connector of instant set-up foldable tent frames, comprising:

an upper joint having (a) brackets to be connected with a lower joint;

(b) engaging portions formed at the lower end portion of said brackets for engagement with a locking lever;

(c) a sloped surface formed between said brackets;

(d) a collar formed at a lower end of said sloped surface, wherein said collar has an inner surface, an outer surface, and a bottom surface;

a lower joint having (a) an inserting portion having a longitudinal axis and configured for receipt of a lower tent frame section;

(b) a connecting portion to be connected to said upper joint by insertion between said brackets;

(c) a sloped surface formed at the upper surface of said connecting portion and extending from a curved surface formed at said upper surface of said connecting portion, wherein said sloped surface has a bottom edge that is contiguous with an outer side surface of said lower joint extending linearly from the bottom edge of the inserting portion to the sloped surface across the entire length of said bottom edge, wherein the entire said sloped surface extending from said bottom edge to said curved surface is a single planar surface that has a surface normal that is not parallel with said longitudinal axis of said inserting portion and contacts a planar portion of said sloped surface of said upper joint when said upper joint and said lower joint are arranged in an unfolded position with respect to one another, wherein said curved surface does not contact said sloped surface of said upper joint when said upper joint and said lower joint are arranged in the unfolded position with respect to one another, wherein the portion of said side surface contiguous with said bottom edge of said sloped surface of said lower joint has a surface normal that is not parallel with said longitudinal axis of said inserting portion;

wherein the connecting portion of the lower joint is connected to the upper joint by insertion between said brackets of the upper joint by means of pin holes and a pin enabling said two joints to perform articular operations; and a locking lever pivotally mounted on said lower joint, wherein said locking lever is configured for engaging said engaging portions of said brackets in order to lock the upper joint and the lower joint in position with one another, wherein when said upper joint and said lower joint are locked in position with one another said inner surface of said collar contacts said lower joint but does not contact said sloped surface of said lower joint, and wherein said outer surface of said collar and said bottom surface of said collar do not contact said lower joint when said upper joint and said lower joint are locked in position with one another.

* * * * *